US005918341A

United States Patent [19]

Hale

[11] Patent Number: 5,918,341

[45] Date of Patent: Jul. 6, 1999

[54] HAND-SIZED, CONTROLLED-FOLD, CLEANING SLEEVE

[76] Inventor: Daniel D. Hale, 230 S. Broadview, Anaheim, Calif. 92804

[21] Appl. No.: 08/903,577

[22] Filed: Jul. 31, 1997

Related U.S. Application Data

[60] Provisional application No. 60/024,426, Aug. 20, 1996.

[51] Int. Cl.[6] ..... A47L 13/16; A47L 25/00; B24D 11/00

[52] U.S. Cl. ..... 15/209.1; 15/104.93; 15/118; 15/208; 451/526; D6/608; D8/90; D32/35

[58] Field of Search ..... 15/104.93, 118, 15/208, 209.1; 451/526, 527, 529, 533; 40/124.09, 124.14, 539; D6/608, 609; D8/90; D32/35, 40, 43

[56] References Cited

U.S. PATENT DOCUMENTS

| | | | |
|---|---|---|---|
| D. 96,899 | 9/1935 | Cohen et al. | D5/30 |
| D. 97,464 | 11/1935 | Cohen et al. | D5/30 |
| D. 98,795 | 3/1936 | Corwin | D5/30 |
| D. 355,096 | 2/1995 | Lang | D6/608 |
| 449,930 | 4/1891 | Dubey | 451/529 |
| 1,635,350 | 7/1927 | Simons | 451/527 |
| 2,778,044 | 1/1957 | Mikulski | 15/118 X |
| 3,050,357 | 6/1962 | Belleni | 15/209.1 |
| 3,144,671 | 8/1964 | Gould et al. | 15/1.51 |
| 3,169,264 | 2/1965 | Walker | 15/118 |
| 4,359,798 | 11/1982 | Loran | 15/104.94 |
| 5,148,572 | 9/1992 | Wells et al. | 15/118 |
| 5,761,761 | 6/1998 | An | 15/209.1 |

FOREIGN PATENT DOCUMENTS

| | | | |
|---|---|---|---|
| 502404 | 3/1939 | United Kingdom | 15/208 |

*Primary Examiner*—Mark Spisich
*Attorney, Agent, or Firm*—Gene Scott; Patent Law & Venture Group

[57] ABSTRACT

This invention is a foldable material having a surface appropriate for manual, contact maintenance, such as a cloth, of such size as to enable the folding of the cloth into parallel panels, each of which is approximately hand-sized. Each of the panels can be visually discriminated from the others by a line imprinted on the panel surface, and each of the panels is sequentially numbered. The foldable material is folded in half and sewn along the long end forming a sleeve. The invention also includes the method of using the foldable material by following a series of directions as to how to fold the material and then using each of the panels in a preferred order of use, thus maximizing the use of the surface area of the material and eliminating waste or contamination.

6 Claims, 2 Drawing Sheets

HAND-SIZED, CONTROLLED-FOLD, CLEANING SLEEVE

This application is based on provisional application Ser. No. 60/024,426, which was filed on Aug. 20, 1996 and claims its filing date for all matter in common therewith. Initial disclosure was made under the Document Disclosure Program, document no. 400311, which was received in the mailroom of the PTO on Jul. 26, 1996.

BACKGROUND OF THE INVENTION

1. Field of the Invention

This invention relates generally to cloths, sponges and other manual janitorial and maintenance devices, and more particularly to a flexible cloth or sponge having a configuration particularly suited to highly efficient use thereof for manual cleaning, buffing and other similar operations.

2. Description of Related Art

The following art defines the present state of this field:

Cohen et al., U.S. D96,899 describes the design for a textile fabric or similar article of manufacture Cohen et al., U.S. D97,464 describes the design for a textile fabric or similar article of manufacture Corwin, U.S. D98,795 describes the design for an imitation leather or similar article.

Gould et al., U.S. Pat. No. 3,144,671 describes a fabric for dust cloths and the like in which a substantially major portion of the fabric surface is comprises of flat, substantially untwisted mono-filament non-fibrous yarns, consisting of a tribo-electrostatic plastic.

Walker, U.S. Pat. No. 3,169,264 describes a multipurpose cleaning and washing cloth employed for various household purposes and also to wash cloths for personal use. The invention provides a novel composite cloth, suitable for various uses, which will present both a rough, mildly abrasive surface and a soft absorbent surface.

Loran, U.S. Pat. No. 4,359,798 describes a cleaning and lubricating system. The system includes an applicator comprises of a substrate carrying an excess of cleaning and lubricating compositions, and a buffing member, preferably in combination with the applicator.

Wells et al., U.S. Pat. No. 5,148,572 describes a kit for cleaning the contact on video game consoles and cartridges comprising a cleaning solution, a cleaning clip, a cleaning card and a pair of cleaning wands. The cleaning solution is applied to the contacts of the console or the cartridge using one end of the cleaning card to remove dirt and other low voltage build up. The contacts are then dried with the opposite en of the cleaning card.

The prior art teaches many different cloths used for various cleaning chores. However, the prior art does not teach a cloth designed, sized, folded and numbered to maximize the effective use of the cloth's surface area and to prevent waste so that manual cleaning, polishing and buffing jobs are completed quicker and with less work. The prior art does not teach a method of use of a cleaning cloth such that work is easier and finished quicker. The present invention fulfills these needs and provides further related advantages as described in the following summary.

SUMMARY OF THE INVENTION

The present invention teaches certain benefits in construction and use that give rise to the objectives described below.

The present invention provides a foldable material having a surface appropriate for manual, contact maintenance, such as a cloth. The cloth has the surface apportioned as an obverse side of the cloth, and in opposition thereto, a reverse side of the cloth. The cloth is of such an over all size as to be foldable into a plurality of contiguous, parallel panels. In its preferred embodiment, the cloth is of such a size as to enable the folding of the cloth into exactly 16 parallel panels such that each of the panels is approximately hand-sized. The preferred size of the cloth is approximately 16 inches wide by 19 inches long, causing each of the panels to be approximately 4 inches wide by 9 inches long.

Each of the panels can be uniquely identified by one of a plurality of indicia including but not limited to numbers or sequential letters. Each of the 16 panels can be visually discriminated from the others with various visual discrimination means, including but not limited to lines imprinted on the cloth surface to identify the separate panels.

The invention is also a method of using the instant maintenance device. The method includes several steps defining the folding and refolding of the device in such a sequential and logical manner as to assure the use of the entire cloth while reducing the possibility of cross-contaminating as surface being worked on with the cloth. The method assures that the cloth is always hand-sized and that as portions of the cloth become used, they are able to be folded out of use. The folding of the cloth is preferably completed along lines imprinted on the cloth surface so as to assure proper folding of the cloth.

A primary objective of the present invention is to provide a cloth designed, sized, and folded to maximize the effective use of the cloth's surface area while preventing cross-contamination. A cloth with these features has advantages not taught by the prior art.

Another objective is to provide a cloth which, when folded into its usable configuration, is sized to fit the hand of the user.

Another objective is to provide a cloth that is sewn into a sleeve to guide the user in the use of the cloth to assure that the maximum surface area of the cloth is utilized.

Another objective is to provide a cloth that is folded in such a manner that a soiled surface is never in direct contact with a non-soiled surface.

A further objective is to provide surface indicia to guide the user in the folding and use of the cloth to assure that the maximum surface area of the cloth is used and that none of the cloth's surface is unused.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
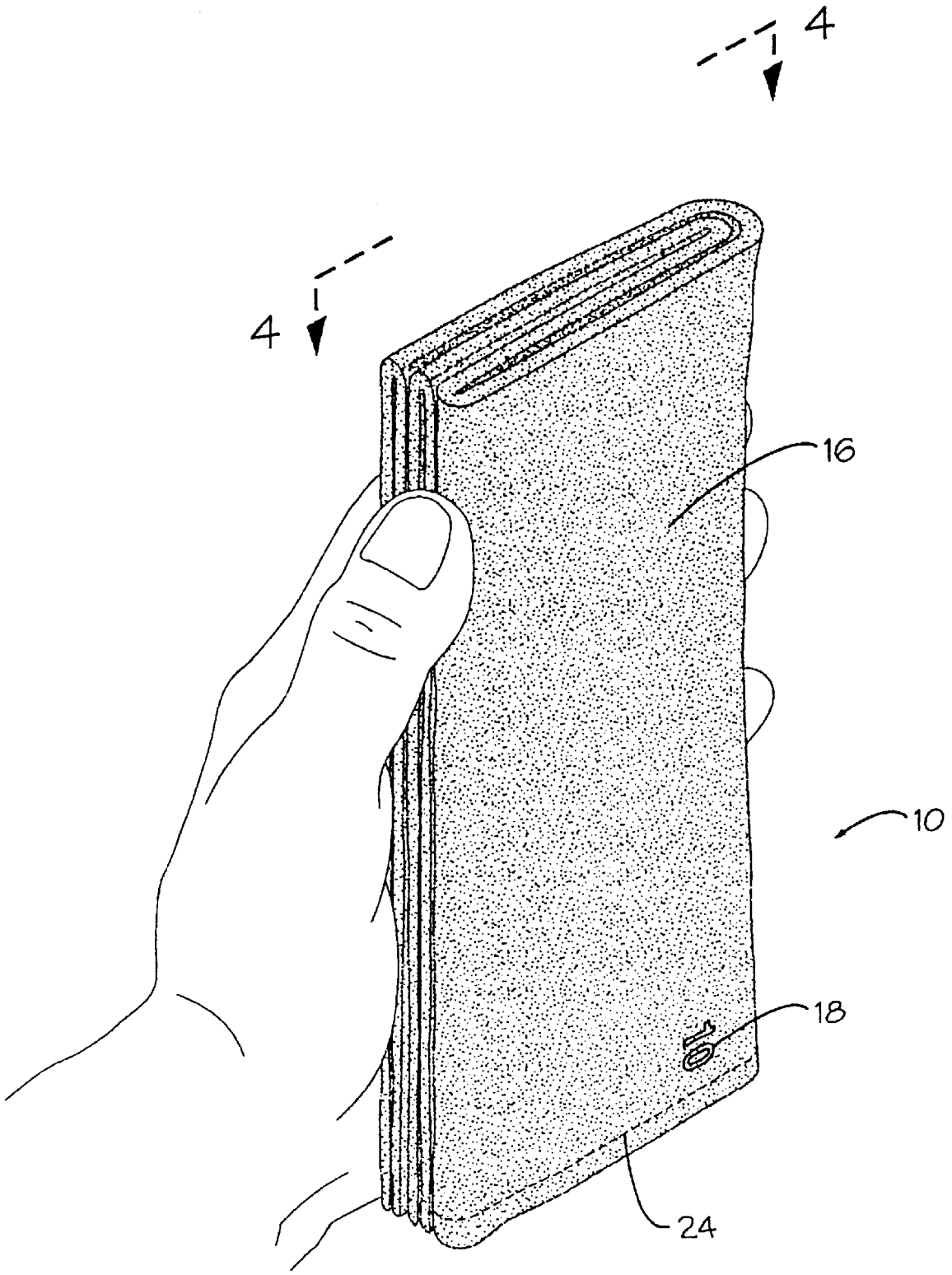
FIG. 1 is a perspective view of the preferred embodiment of the present invention indicating and showing the relative size of the invention when folded and its size relationship to that of the hand of an adult.

The above described drawing figures illustrate the invention, a foldable material having a surface appropriate for manual, contact maintenance, such as a cloth 10. The cloth can be made of any flexible material including but not limited to the following: woven fibers such as cotton, preferably terrycloth; animal skins, preferably chamois; sponge and various synthetic materials selected for their utilitarian desirable properties as will be known by those skilled in the art. In one preferred embodiment, the foldable material is a soft and absorbent material such as terrycloth. The cloth advantageously may have the properties of being hydrophillic, hydrophobic, abrasive or any other property desirable in a hand held device with a surface for application to the maintenance of an object. The cloth surface may also have an impregnant such as an anti-tarnish chemical formulation or other surface modification means.

The cloth surface 10A is preferably apportioned as an obverse side of the cloth 10, and in opposition thereto, a reverse side of the cloth 10. The cloth 10 is of such an overall size as to be foldable into a plurality of contiguous, parallel panels 16. It is preferred that the edges of the cloth are treated or sewn to form a hem 17 to prevent unraveling of the cloth. In its preferred embodiment, the cloth is of such a size as to enable the folding of the cloth into exactly 16 parallel panels 16 such that each of the parallel panels 16 is approximately hand-sized. The preferred size of the cloth is approximately 16 inches wide by 19 inches long, causing each of the panels to be approximately 4 inches wide by 9 inches long. The invention of such a hand-sized collection of panels is considered a highly novel and inventive feature of the invention. The use of the word "panels" is meant to define sub-portions of the cloth's surface 10A where each of the panels constitutes a working surface of the cloth 10 when applied in its preferred manner in accordance with the method of the invention. A wide variety of different quantities and arrangements of such panels defined from various sized cloths can be imagined which would not deviate from the scope of this invention. The specific disclosures made in this patent application should be taken as an example of one possible configuration of an infinite number of embodiments possible within the scope of the present invention.

Each of the panels 16 can be uniquely identified by one of a plurality of indicia 18 including but not limited to numbers, arrows, colors, letters, et cetera.. Each of the panels 16 may alternately be visually discriminated from the others with various visual discrimination means, including but not limited to a line or lines 20 imprinted on the cloth surface 10A so as to indicate the extent and boundaries of the panels.

Figure 3:
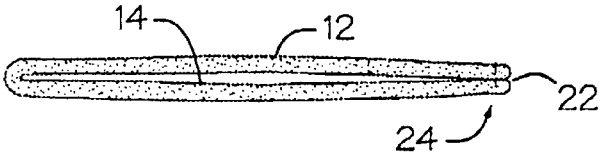
FIG. 3 is a an end view of the sleeve of FIG. 2.

As shown in FIG. 3, when the cloth 10 is folded in half, it forms a long, open side 22. In its best mode, this long, open side 22 is preferably fastened closed with a fastening means 24. The fastening means is preferably thread stitching that is sewn along the joined edges of the cloth to form a closure. After the cloth has been sewn closed at the long, open side 22, the cloth forms a sleeve 26 having open ends 11. This sleeve configuration is preferred because it enables the user to more easily fold the cloth into its correct panel 16 configuration and facilitates correct use of the cloth as well as maximum use of the entire surface area of the cloth. However, other shapes and configurations are possible without deviating from the scope of this invention.

Figure 2:
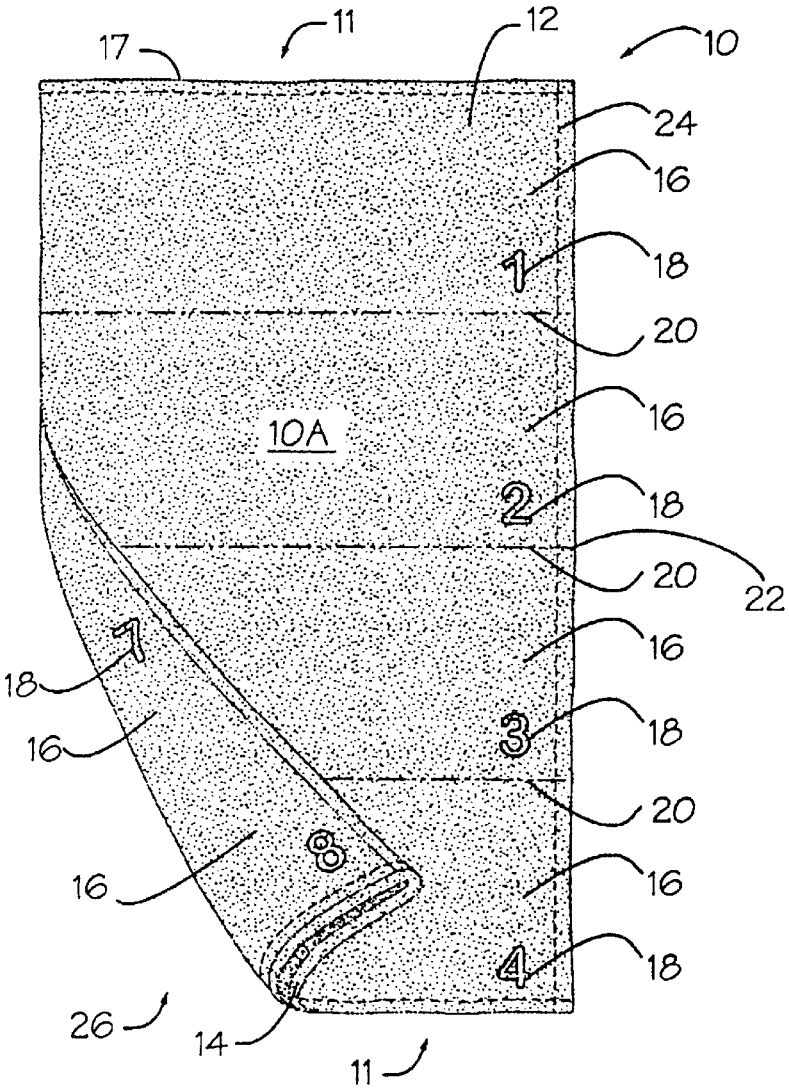
FIG. 2 is a plan view thereof showing the invention as folded and sewn into a sleeve.
Figure 4:
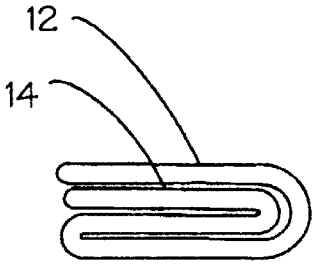
FIG. 4 is a side view taken as directed in line 4—4 in FIG. 1.

The invention also includes a method of using the instant foldable material for manual, contact maintenance. The method includes several steps. First, providing the cloth 10 as described above. Second, folding the cloth to halve a length of the cloth, as shown in FIGS. 2 and 3. Third, folding the cloth to halve a width of the cloth, as shown in FIG. 4. Fourth, folding the cloth to quarter the width of the cloth as shown in FIGS. 1 and 4, thereby creating exactly 16 parallel panels 16. Each of the panels should be approximately hand-sized, the first and second panels being exposed as obverse and reverse panels of the device. Fifth, using the first of the panels until the cloth surface comprising said first of the panels is further unusable. Sixth, turning the device over so as to use the second of the panels until the cloth surface comprising said second of the panels is further unusable. Seventh, folding the cloth to place the first and second of the panels into direct mutual contact thereby exposing, as obverse and reverse panels, a third and a fourth of the panels. Eighth, using the third of the panels until the cloth surface comprising said third of the panels is further unusable. Ninth, turning the device over so as to use the fourth of the panels until the cloth surface comprising said fourth of the panels is further unusable. Tenth, folding the cloth to place a seventh and eighth of the panels into direct contact thereby exposing as obverse and reverse panels, a fifth and sixth panels. Eleventh, using the fifth of the panels until the cloth surface comprising said fifth of the panels is further unusable. Twelfth, turning the device over so as to use the sixth of the panels until the cloth surface comprising said sixth of the panels is further unusable. Thirteenth, folding the cloth to place the fifth and sixth of the panels into direct contact thereby exposing as obverse and reverse sides, a seventh and an eighth panels. Fourteenth, using the seventh of the panels until the cloth surface comprising said seventh of the panels is further unusable. Fifteenth, turning the device over so as to use the eighth of the panels until the cloth surface comprising said eight of the panels is further unusable. Sixteenth, fully unfolding the device. Finally, repeating the previous steps for the side of the cloth not yet used in order to use the ninth through the sixteenth panels. The folding of the above steps can be completed along at least one line imprinted on the cloth surface 20 and preferably along lines 20 as shown in FIG. 2 marking the boundaries between adjacent panels 16.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A maintenance device comprising:

a substantially rectangular material which is foldable and which has a surface on a front and back side thereof which is appropriate for manual, contact maintenance;

said material having a plurality of visible lines imprinted thereon and extending across the width of the material, said lines dividing the material into a plurality of discrete panel sections and functioning as a visual discrimination means;

each of the panel sections including a unique one of a plurality of indicia, the plurality of indicia being selected from the group consisting of numbers and letters of an alphabet, the plurality of indicia further being in a recognizable sequence;

the material being foldable along each of the lines of said visual discrimination means whereby said material is formed into a hand sized body having the dimensions of one of said panels sections, the sequential indicia providing the user with a means by which the user may sequentially utilize the panel sections.

2. The device of claim 1 wherein the foldable material is hydrophillic.

3. The device of claim 1 wherein the foldable material is hydrophobic.

4. The device of claim 1 wherein the foldable material is abrasive.

5. The device of claim 1 wherein the foldable material is approximately 16 inches wide by 19 inches long and each of the panels is approximately 4 inches wide by 9 inches long.

6. The device of claim 1 wherein the foldable material is formed as a sleeve having open ends.

* * * * *